US006273422B1

(12) United States Patent
McGahan

(10) Patent No.: US 6,273,422 B1
(45) Date of Patent: Aug. 14, 2001

(54) THREE DIMENSIONAL ALIGNMENT GAME PLAYING SYSTEM AND METHOD

(76) Inventor: Terrence J. McGahan, 10912 S. Millard, Chicago, IL (US) 60655

( * ) Notice: Subject to any disclaimer, the term of this patent is extended or adjusted under 35 U.S.C. 154(b) by 0 days.

(21) Appl. No.: 09/435,713

(22) Filed: Nov. 8, 1999

(51) Int. Cl.[7] ..... A63F 3/00

(52) U.S. Cl. ..... 273/241; 273/264; 273/271; 273/280

(58) Field of Search ..... 273/241, 264, 273/271, 280, 287, 260, 261

(56) References Cited

U.S. PATENT DOCUMENTS 3,604,705 * 9/1971 Hawthorne .
3,661,391 * 5/1972 Henshaw .
3,804,416 * 4/1974 Jones et al. .
4,184,685 * 1/1980 Wilson .
5,031,917 7/1991 Greene ..... 273/241
5,085,440 2/1992 Van Dam ..... 273/241
5,277,419 1/1994 Craig ..... 273/241
5,316,307 * 5/1994 Kersh .
5,338,040 8/1994 Cutler ..... 273/241
5,409,234 4/1995 Bechter ..... 273/241
5,443,268 8/1995 Mayfield et al. ..... 273/241
5,794,932 * 8/1998 Gastone .

* cited by examiner

*Primary Examiner*—William M. Pierce
(74) *Attorney, Agent, or Firm*—Joseph N. Breaux

(57) ABSTRACT

A strategy game system and method that requires a player to align three markers wherein each marker is positioned at one of three levels.

7 Claims, 1 Drawing Sheet

THREE DIMENSIONAL ALIGNMENT GAME PLAYING SYSTEM AND METHOD

TECHNICAL FIELD

The present invention relates to alignment games such as tic-tac-toe and more particularly to a three dimensional alignment game playing system and method wherein the three-dimensional alignment game playing system includes a game piece alignment assembly including a top, a middle and a bottom, rotatable, nine-marker receiving table positioned one above the other, respectively, and in mechanical connection such that each of the nine-marker receiving tables is rotatable independently of the other two nine-marker receiving tables; each nine-marker receiving table having nine individual marker receiving areas arranged in three parallel rows each including three individual marker receiving areas; two multi-piece player sets each including a number of markers; the markers of each multi-piece player set having an identifying characteristic in common and a readily identifiable characteristic to distinguish it from the markers of the other multi-piece player set; the game method including the steps of a) supplying a three dimensional alignment game system as described above; b) providing each player with one of the multi-piece player sets; c) allowing each player a play in rotation from first to last player, a play being either the positioning of one marker on one of the marker receiving areas of one of the top, middle or bottom nine-marker receiving tables or rotating one of the top, middle or bottom nine-marker receiving tables with respect to the other two nine-marker receiving tables; and continuing play until one player has three markers, one on each of the top, middle or bottom nine-marker receiving tables, in alignment.

BACKGROUND ART

Many individuals enjoy playing games that require strategy. It would be a benefit, therefore, to have a strategy game that required a player to align three markers wherein each marker is positioned at one of three levels.

GENERAL SUMMARY DISCUSSION OF INVENTION

It is thus an object of the invention to provide a three dimensional alignment game system that includes a game piece alignment assembly including a top, a middle and a bottom, rotatable, nine-marker receiving table positioned one above the other, respectively, and in mechanical connection such that each of the nine-marker receiving tables is rotatable independently of the other two nine-marker receiving tables; each nine-marker receiving table having nine individual marker receiving areas arranged in three parallel rows each including three individual marker receiving areas; two multi-piece player sets each including a number of markers; the markers of each multi-piece player set having an identifying characteristic in common and a readily identifiable characteristic to distinguish it from the markers of the other multi-piece player set.

It is a further object of the invention to provide a three dimensional alignment game playing method that includes the steps of a) supplying a three dimensional alignment game system as described above; b) providing each player with one of the multi-piece player sets; c) allowing each player a play in rotation from first to last player, a play being either the positioning of one marker on one of the marker receiving areas of one of the top, middle or bottom nine-marker receiving tables or rotating one of the top, middle or bottom nine-marker receiving tables with respect to the other two nine-marker receiving tables; and continuing play until one player has three markers, one on each of the top, middle or bottom nine-marker receiving tables, in alignment.

Accordingly, in a first aspect of the invention a three dimensional alignment game system is The three dimensional alignment game system includes a game piece alignment assembly including a top, a middle and a bottom, rotatable, nine-marker receiving table positioned one above the other, respectively, and in mechanical connection such that each of the nine-marker receiving tables is rotatable independently of the other two nine-marker receiving tables; each nine-marker receiving table having nine individual marker receiving areas arranged in three parallel rows each including three individual marker receiving areas; two multi-piece player sets each including a number of markers; the markers of each multi-piece player set having an identifying characteristic in common and a readily identifiable characteristic to distinguish it from the markers of the other multi-piece player set In a second aspect of the invention, a three dimensional alignment game playing method is provided that includes the steps of a) supplying a three dimensional alignment game system as described above; b) providing each player with one of the multi-piece player sets; c) allowing each player a play in rotation from first to last player, a play being either the positioning of one marker on one of the marker receiving areas of one of the top, middle or bottom nine-marker receiving tables or rotating one of the top, middle or bottom nine-marker receiving tables with respect to the other two nine-marker receiving tables; and continuing play until one player has three markers, one on each of the top, middle or bottom nine-marker receiving tables, in alignment.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
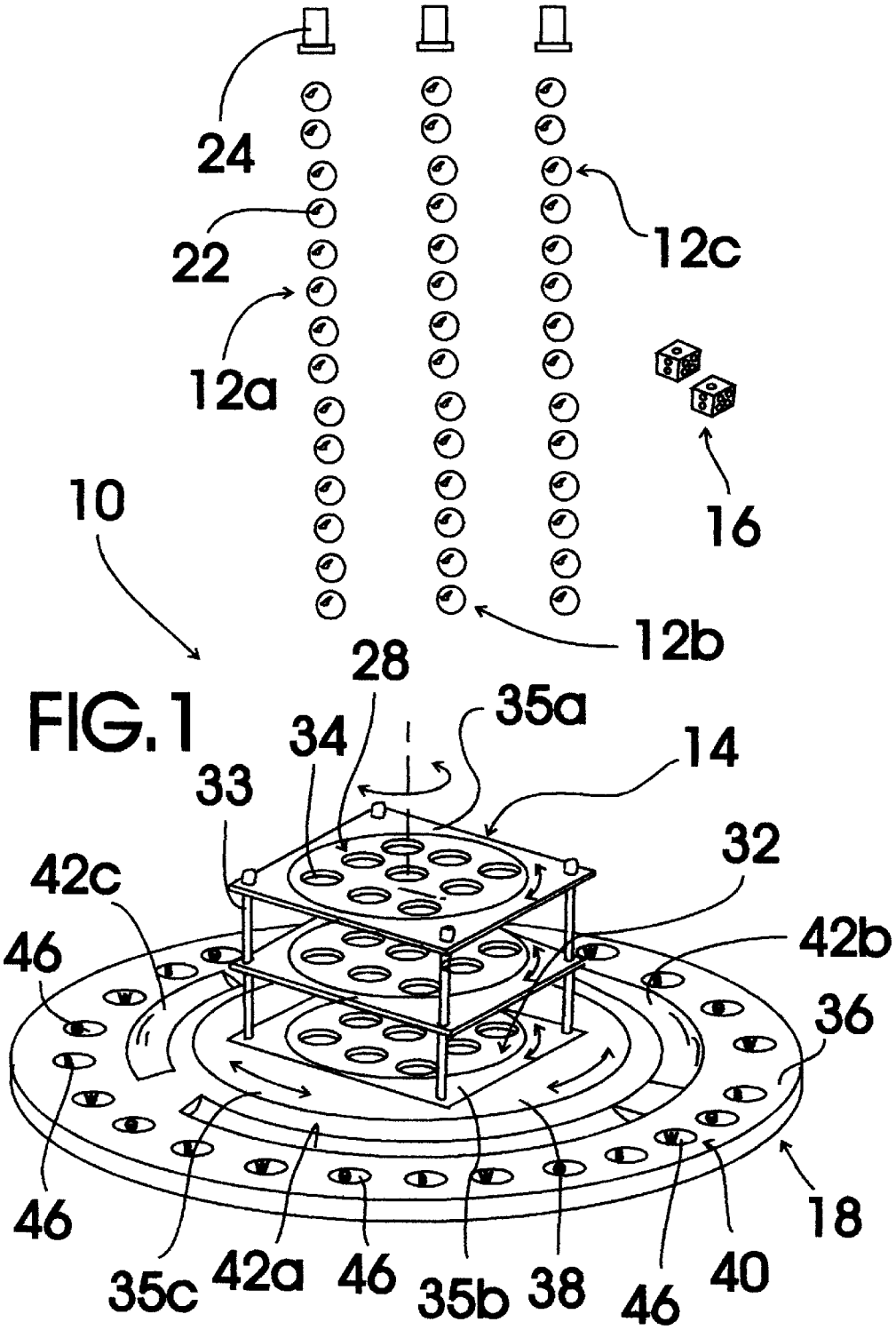
FIG. 1 is a perspective view of an exemplary embodiment of the three dimensional alignment game playing system of the present invention showing a game piece alignment assembly including the top, middle and bottom, rotatable, nine-marker receiving tables positioned one above the other, respectively, and in mechanical connection such that each of the nine-marker receiving tables is rotatable independently of the other two nine-marker receiving tables; each nine-marker receiving table having nine individual marker receiving areas arranged in three parallel rows each including three individual marker receiving areas; a pair of dice; two multi-piece player sets each including number of markers and at least one game piece, the markers and the game piece of each multi-piece player set having an identifying characteristic in common and a readily identifiable characteristic to distinguish it from the markers and the game piece of the other multi-piece player set; a board assembly having a circular turntable, a game board area, and two separate marker holding channels; the game piece alignment assembly being mounted upon the circular turntable such that rotation of the circular turntable causes the entire game piece alignment assembly to rotate in unison; the game board area having a continuous pathway of game piece landing areas designated thereon wherein each game piece landing area is designated with a designation indicating one of the identifying characteristics of one of the multi-piece sets and a level designation indicating one of the top, middle or bottom nine-marker receiving tables; the two separate marker holding channels being formed therein for holding the markers not yet positioned onto a nine-marker receiving table.

FIG. 1 shows an exemplary embodiment of the three dimensional alignment game playing system of the present invention generally designated 10. Game playing system 10 includes three multi-piece player sets, generally designated 12*a–c*; a game piece alignment assembly, generally designated 14; a pair of dice, generally designated 16; and a board assembly, generally designated 18.

Each of the multi-piece player sets 12*a–c* includes fourteen same colored marbles 22 as markers and a same colored game playing piece 24. in this embodiment multi-piece player set 12*a* is colored white, multi-piece player set 12*b* is colored black, and multi-piece player set 12*c* is colored green.

Game piece alignment assembly 14 includes a top, a middle and a bottom, round, rotatable, transparent, nine-marker receiving table, respectively generally designated 28,30,32, positioned one above another, respectively, and in mechanical connection with a three tiered support structure 33 such that each of nine-marker receiving tables 28,30,32 is rotatable independently of the other two nine-marker receiving tables 28,30,32. In this embodiment, three tiered support structure 33 has three square support plates 35*a–c* each having a round disk shaped depression within which the round disk shaped nine-marker receiving tables 28,30, 32, respectively, are rotatably held. Each of the nine-marker receiving tables 28,30,32 has nine marble holes 34, used as the nine individual marker receiving areas, arranged in three parallel rows each including three marble holes 34.

Board assembly 18 includes a circular game board member 36 having a circular turntable 38 rotatable about the center thereof; a ring shaped game board area, generally designated 40; and three separate marble/marker holding channels 42*a–c*. Game piece alignment assembly 14 is mounted upon circular turntable 38 such that rotation of circular turntable 38 causes the entire game piece alignment assembly 14 to rotate in unison.

Game board area 40 has a continuous pathway of game piece landing areas 46 designated thereon wherein each game piece landing area 46 has a printed designation indicating a color (white, black, green) and a level designation indicating one of the top, middle or bottom nine-marker receiving tables 28,30,32. The separate marker holding channels 42*a–c* are formed for holding the marble/markers 22 not yet positioned onto a nine-marker receiving table 28,30,32.

An exemplary game playing method is now described with reference to FIG. 1. A three dimensional alignment game playing method includes the steps of: a) providing a three dimensional alignment game system 10 as described above; b) providing each player with one of multi-piece player sets 12*a–c*; c) allowing each player a play in rotation from first to last player, a play being the rolling of dice 16, moving a game piece 24 along the continuous pathway the number of game piece landing areas 46 designated by the dice 16, determining if game piece 24 landed on a game piece landing area 46 for indicating that game piece color (black, white, green), and if the game piece landing area 46 and the game piece 24 are for the same color, positioning a marble/marker 22 into a marble hole 34 of the one of the nine-marker receiving tables 28,30,32 indicated by the landed on game landing piece area 46 or rotating the one of the nine-marker receiving tables 28,30,32 indicated by the landed on game landing piece area 46 ninety degrees in either direction; and d) continuing play until one player has three marble/markers 22, one on each of the top, middle or bottom nine-marker receiving tables 28,30,32, in alignment.

It can be seen from the preceding description that a three dimensional alignment game system and method have been provided.

It is noted that the embodiment of the three dimensional alignment game system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A three dimensional alignment game system comprising:

two multi-piece player sets; and a game piece alignment assembly including a top, a middle and a bottom, rotatable, nine-marker receiving table positioned one above another, respectively, and in mechanical connection such that each of said nine-marker receiving tables is rotatable independently of said other two nine-marker receiving tables;

each nine-marker receiving table having nine individual marker receiving areas arranged in three parallel rows each including three individual marker receiving areas;

each of said two multi-piece player sets including a number of markers;

said markers of each multi-piece player set having an identifying characteristic in common and a readily identifiable characteristic to distinguish it from said markers of said other multi-piece player set.

2. The three dimensional alignment game system of claim 1 further including:

a board assembly having a circular turntable;

said game piece alignment assembly being mounted upon said circular turntable such that rotation of said circular turntable causes said entire game piece alignment assembly to rotate in unison.

3. The three dimensional alignment game system of claim 1 wherein:

each of said two multi-piece player sets further includes a game piece; and said three dimensional alignment game system further includes:

a die; and a board assembly having a game board area having a continuous pathway of game piece landing areas designated thereon wherein each game piece landing area is designated with a designation indicating one of said identifying characteristics of one of said multi-piece sets and a level designation indicating one of said top, middle or bottom nine-marker receiving tables.

4. The three dimensional alignment game system of claim 3 wherein:

said board assembly further includes a circular turntable; and said game piece alignment assembly is mounted upon said circular turntable such that rotation of said circular turntable causes said entire game piece alignment assembly to rotate in unison.

5. The three dimensional alignment game system of claim 4 wherein:

said board assembly further includes two separate marker holding channels formed therein for holding said markers not yet positioned onto one of said top, middle and bottom nine-marker receiving table.

6. A three dimensional alignment game playing method comprising the steps of:

a) providing a three dimensional alignment game system comprising:

two multi-piece player sets; and a game piece alignment assembly including a top, a middle and a bottom, rotatable, nine-marker receiving table positioned one above another, respectively, and in mechanical connection such that each of said nine-marker receiving tables is rotatable independently of said other two nine-marker receiving tables;

each nine-marker receiving table having nine individual marker receiving areas arranged in three parallel rows each including three individual marker receiving areas;

each of said two multi-piece player sets including a number of markers;

said markers of each multi-piece player set having an identifying characteristic in common and a readily identifiable characteristic to distinguish it from said markers of said other multi-piece player set;

b) providing each player with one of said multi-piece player sets;

c) allowing each player a play in rotation from first to last player, a play being either positioning of one marker on one of said marker receiving areas of one of said top, middle or bottom nine-marker receiving tables or rotating one of said top, middle or bottom nine-marker receiving tables with respect to said other two nine-marker receiving tables; and d) continuing play until one player has three markers, one on each of said top, middle or bottom nine-marker receiving tables, in alignment.

7. A three dimensional alignment game playing method comprising the steps of:

a) providing a three dimensional alignment game system comprising:

two multi-piece player sets;

a game piece alignment assembly including a top, a middle and a bottom, rotatable, nine-marker receiving table positioned one above another, respectively, and in mechanical connection such that each of said nine-marker receiving tables is rotatable independently of said other two nine-marker receiving tables;

a die; and a board assembly having a game board area having a continuous pathway of game piece landing areas designated thereon wherein each game piece landing area is designated with a designation indicating one of said identifying characteristics of one of said multi-piece sets and a level designation indicating one of said top, middle or bottom nine-marker receiving tables;

nine-marker receiving table having nine individual marker receiving areas arranged in three parallel rows each including three individual marker receiving areas;

each of said two multi-piece player sets including a number of markers and a game playing piece;

said markers and said game playing piece of each multi-piece player set having an identifying characteristic in common and a readily identifiable characteristic to distinguish it from said markers and said game playing piece of said other multi-piece player set;

b) providing each player with one of said multi-piece player sets;

c) allowing each player a play in rotation from first to last player, a play being the rolling of a die, moving a said game piece along said continuous pathway the number of game piece landing areas designated by the die, determining if said game piece landed on a game piece landing area for indicating that game piece, and if the game piece landing area and the game piece correspond, positioning a marker on or rotating the indicated one of said top, middle or bottom nine-marker receiving tables;

d) continuing play until one player has three markers, one on each of said top, middle or bottom nine-marker receiving tables, in alignment.

* * * * *